US005544508A

United States Patent [19]

Torkowski

[11] Patent Number: 5,544,508

[45] Date of Patent: Aug. 13, 1996

[54] MOTOR-VEHICLE CENTRAL LOCK SYSTEM FOR TRUNK AND GAS-FILLER DOORS

[75] Inventor: Thorsten Torkowski, Herne, Germany

[73] Assignee: Kiekert Aktiengesellschaft, Heiligenhaus, Germany

[21] Appl. No.: 391,678

[22] Filed: Feb. 21, 1995

[30] Foreign Application Priority Data

Apr. 16, 1994 [DE] Germany ..... 44 13 277.8

[51] Int. Cl.[6] ..... E05B 63/14

[52] U.S. Cl. ..... 70/264; 70/257; 70/275; 70/280; 292/144; 292/DIG. 25

[58] Field of Search ..... 70/264, 256, 257, 70/265, 262, 263, 275, 277, 280; 292/DIG. 25, DIG. 43, 3, 22, 26, 36, 48, 144; 296/97.22

[56] References Cited

U.S. PATENT DOCUMENTS

| | | | |
|---|---|---|---|
| 2,548,242 | 4/1951 | Rosenbarger | 70/256 |
| 3,996,591 | 12/1976 | Hayward | 292/3 |
| 4,277,094 | 7/1981 | Roue | 796/97.22 |
| 4,468,942 | 9/1984 | Grabner et al. | 70/264 |
| 4,669,283 | 6/1987 | Ingenhoven . | |
| 4,691,584 | 9/1987 | Takaishi et al. | 292/DIG. 25 |
| 4,727,735 | 3/1988 | Haag et al. | 70/264 |
| 4,821,521 | 4/1989 | Schüler | 292/144 |
| 4,941,694 | 7/1990 | Bartel . | |
| 5,222,774 | 6/1993 | Fukumoto et al. | 296/97.22 |
| 5,308,126 | 5/1994 | Weger, Jr. et al. | 292/48 |
| 5,441,315 | 8/1995 | Kleefedt et al. | 70/264 |

FOREIGN PATENT DOCUMENTS

| | | | |
|---|---|---|---|
| 1024481 | 3/1984 | European Pat. Off. | 292/DIG. 25 |
| 0383727 | 8/1990 | European Pat. Off. | 70/275 |
| 2709157 | 9/1978 | Germany . | |
| 4189988 | 7/1992 | Japan | 70/275 |

*Primary Examiner*—Darnell M. Boucher
*Attorney, Agent, or Firm*—Herbert Dubno; Andrew Wilford

[57] ABSTRACT

A central lock system for a motor vehicle having a trunk door and a gas-filler door, has respective latches at the trunk and gas-filler doors movable between locked and unlocked positions corresponding to locked and unlocked conditions of the respective doors and an actuator adjacent the trunk latch having a single output member displaceable between an actuated and an unactuated position and a motor connected to the member for displacing same between the respective positions. Respective trunk and gas-filler links are connected to the respective latches and are both connected to the member. A controller is connected to the motor for actuating same and thereby simultaneously moving the trunk and gas-filler latches between the locked and unlocked positions.

10 Claims, 3 Drawing Sheets

MOTOR-VEHICLE CENTRAL LOCK SYSTEM FOR TRUNK AND GAS-FILLER DOORS

FIELD OF THE INVENTION

The present invention relates to a central lock system. More particularly this invention concerns a motor-vehicle central lock system which can also work on the trunk and gas-filler doors.

BACKGROUND OF THE INVENTION

A motor vehicle typically has at least two so-called passenger doors used by the driver and others to get into and out of the vehicle, a rear or trunk door or lid used to gain access to the trunk or to a rear storage space, and a gas-filler door that covers the recess in which the outer end of the fill tube for the gas tank is located. Each such door typically has its own latch and in a vehicle equipped with a central lock system, each latch in turn has its own actuator of the type described in German patent 2,709,157 issued 7 Sep. 1978 to R. Andres and in U.S. Pat. Nos. 4,669,283 and 4,941,694. The actuators can be electrically powered or fluid powered, that is driven by pressurized hydraulic fluid or compressed air.

The central lock system further has a central controller that is typically operated by the driver's-door latch, itself operated mechanically by a key or remotely via a coded radio-frequency or infrared transmitter. Thus such a lock system is fairly complex and therefore quite expensive. Numerous expensive actuators must all be connected to the common controller, resulting in a complicated arrangement.

OBJECTS OF THE INVENTION

It is therefore an object of the present invention to provide an improved motor-vehicle central lock system.

Another object is the provision of such an improved motor-vehicle central lock system which overcomes the above-given disadvantages, that is which is substantially simpler and cheaper to manufacture than the prior-art systems.

SUMMARY OF THE INVENTION

A central lock system for a motor vehicle having a trunk door and a gas-filler door, has according to the invention respective latches at the trunk and gas-filler doors movable between locked and unlocked positions corresponding to locked and unlocked conditions of the respective doors and an actuator adjacent the trunk latch having a single output member displaceable between an actuated and an unactuated position and a motor connected to the member for displacing same between the respective positions. Respective trunk and gas-filler links are connected to the respective latches and are both connected to the member. A controller is connected to the motor for actuating same and thereby simultaneously moving the trunk and gas-filler latches between the locked and unlocked positions.

Thus the system of this invention eliminates one of the actuators altogether by operating the trunk or hatch latch with the same actuator as the gas-filler door or flap. Admittedly whenever the trunk or rear hatch is unlocked, the gas-filler door is also unlocked, but this is no disadvantage, especially as when the vehicle is locked down, both these doors will lock at the same time. The cost of a separate actuator and operating circuit is much greater than that of a simple link from the trunk-door latch to the gas-filler latch, which is typically fairly close by.

According to this invention the output member has two ends each connected via a respective one of the links to the latches. The actuator is mounted on the trunk door and one of the links, normally the gas-filler link, is constituted as a bowden cable and the other is a rigid lever.

The motor is provided with a gear transmission connecting it to the member and including a rotary gear carrying an eccentric pin coupled with the member. The motor can be electric or fluid powered.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
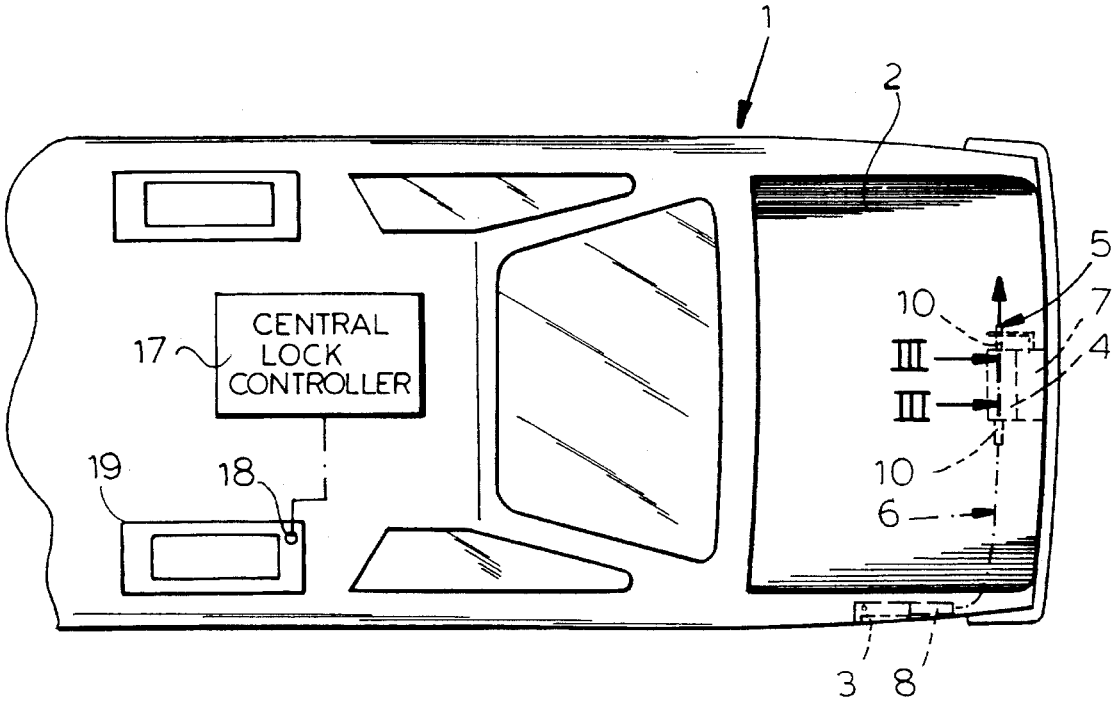
FIG. 1 is a partly diagrammatic small-scale top view of a car equipped with a lock system according to the invention.
Figure 2:
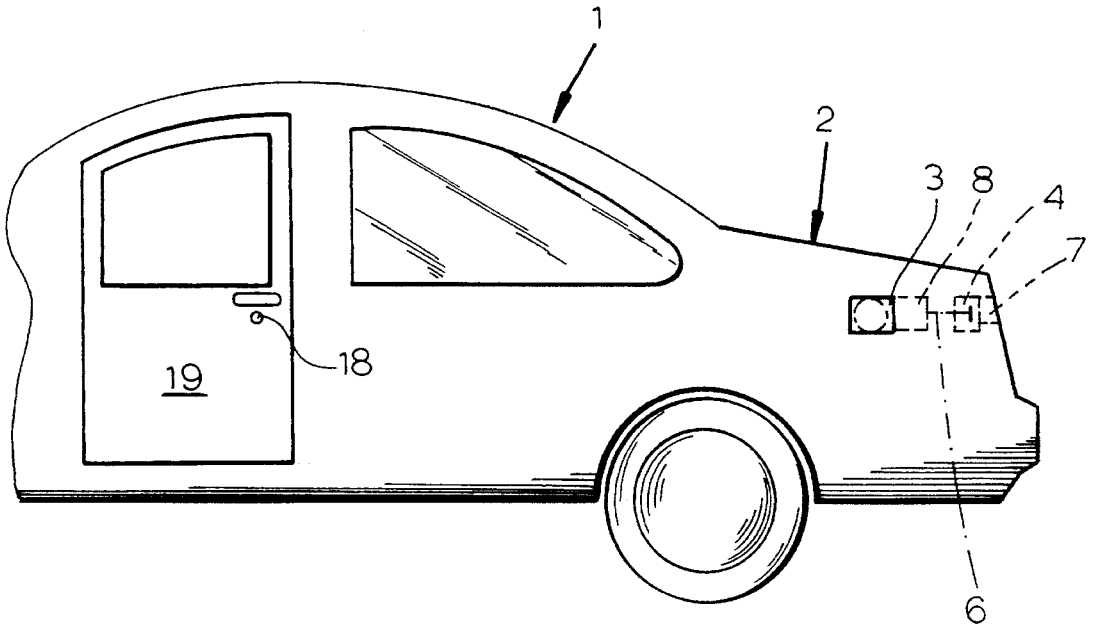
FIG. 2 is a side view of the structure shown in FIG. 1.

As seen in FIGS. 1 and 2 a motor vehicle 1 has a driver door 19 equipped with a key-operated latch 18, a trunk door or lid 2 equipped with a latch 7, and a gas-filler door 3 equipped with a latch 8. The vehicle 1 has a central lock system 17 that can be operated by a key or from a keypad at the driver-door latch 18. A radio-frequency or infrared device can also be used instead of the driver-door lock 18 to actuate the central lock controller 17 and open all the door latches.

According to the invention an actuator 4 is provided on the rear trunk door 2. It is connected via a link lever 5 to the trunk latch 7 and via a bowden-cable link 6 to the gas-filler latch 8.

Figure 3:
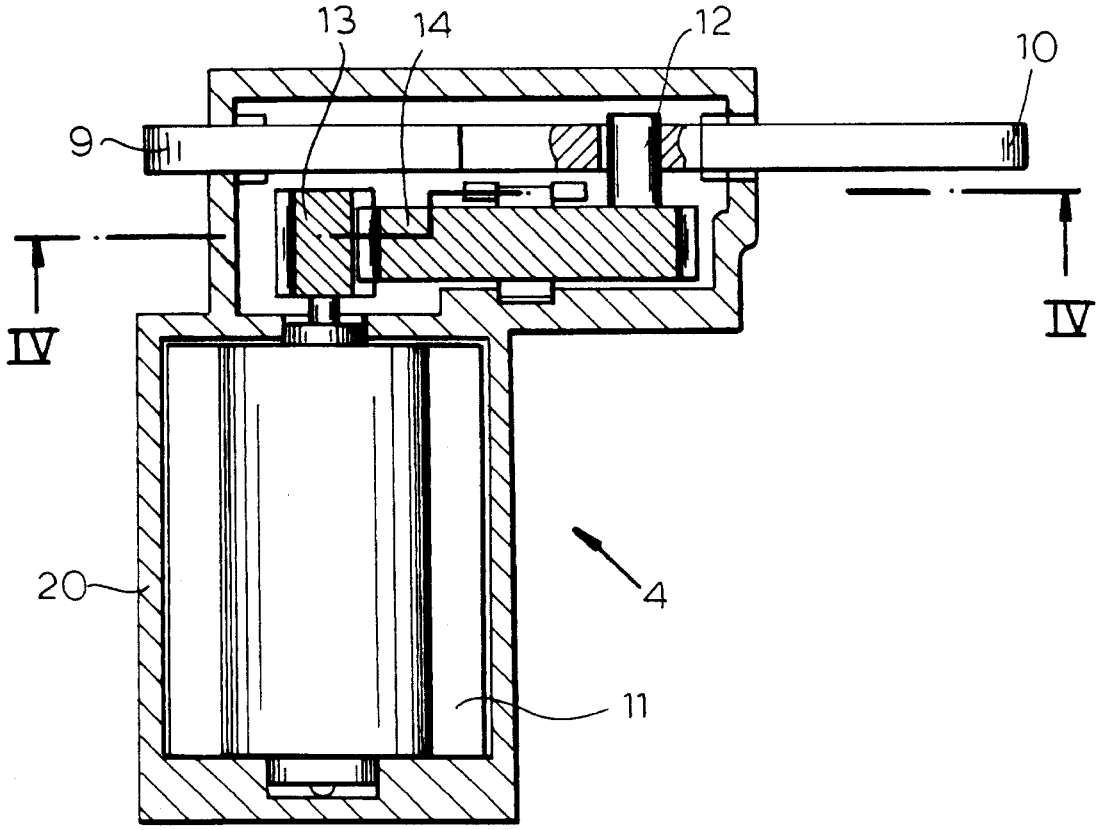
FIG. 3 is a large-scale section taken along line III—III of FIG. 2.
Figure 4:
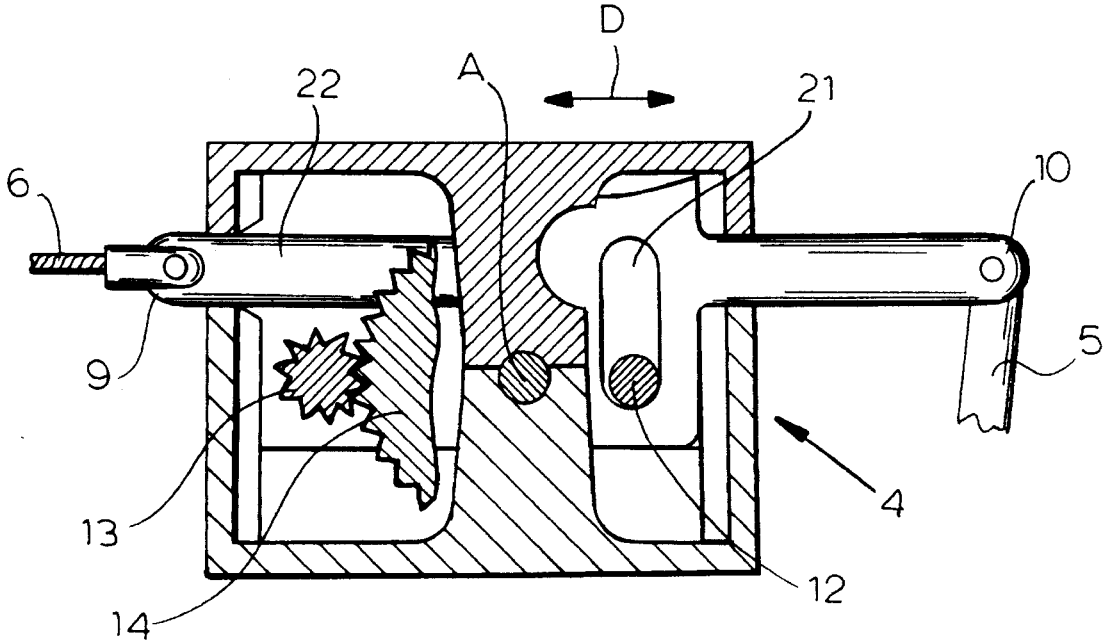
FIG. 4 is a section taken along line IV—IV of FIG. 3.

FIGS. 3 and 4 show how the actuator 4 has a housing 20 containing a motor 11 that may be electrically, hydraulically, or pneumatically powered and that rotates an output pinion 13 in mesh with a gear 14 having an eccentric output pin 12 engaged in a slot 21 extending perpendicular to the direction of travel of an output member 22 having a pair of ends 9 and 10 respectively connected to the bowden link 6 and lever link 5. Alternately the member 22 could be formed as a rack that meshes directly with the pinion 13. Thus rotation of the pinion 13 by the motor 11 moves the pin 12 through an arc to displace the member 22 in the direction D. When moved in one direction both latches 7 and 8 are opened, and when oppositely moved both latches 7 and 8 are locked.

Figure 5:
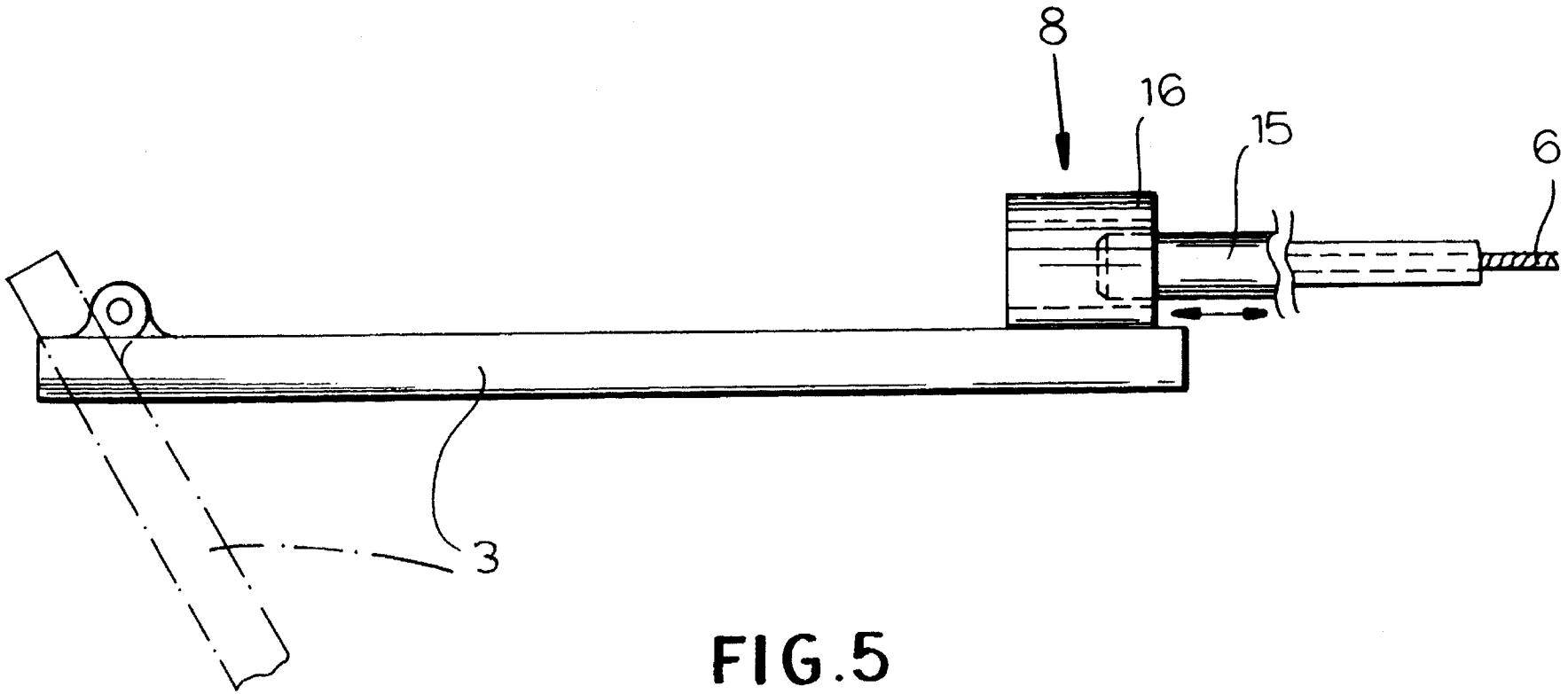
FIG. 5 is a large-scale view of a detail of the gas-filler door and latch of the invention.

As shown in FIG. 5, the latch 8 for the door 3 comprises a bolt 15 operated by the core of the bowden link 6 and a keeper or strike 16 carried on the door 3 itself.

I claim:

1. In a motor vehicle having a trunk door and a gas-filler door, a central lock system comprising:

respective latches at the trunk and gas-filler doors movable between locked and unlocked positions corresponding to locked and unlocked conditions of the respective doors;

an actuator adjacent the trunk latch having a single output member displaceable between an actuated and an unactuated position, and a motor connected to the member for displacing same between the respective positions;

means including respective trunk and gas-filler links connected to the respective latches and both connected to the member for simultaneously displacing both the trunk and gas-filler latches into the respective unlocked conditions on displacement of the output member into the actuated position and into the respective locked conditions on displacement of the output member into the unactuated position; and control means connected to the motor for actuating same and thereby simultaneously moving the trunk and gas-filler latches between the locked and unlocked positions.

2. The motor-vehicle central-lock system defined in claim 1 wherein the output member has two ends each connected via a respective one of the links to the latches.

3. The motor-vehicle central-lock system defined in claim 1 wherein the actuator is mounted on the trunk door.

4. The motor-vehicle central-lock system defined in claim 1 wherein one of the links is constituted as a bowden cable.

5. The motor-vehicle central-lock system defined in claim 4 wherein the other link is a rigid lever.

6. The motor-vehicle central-lock system defined in claim 5 wherein the one link is the gas-filler link.

7. The motor-vehicle central-lock system defined in claim 1 wherein the motor is provided with a gear transmission connecting it to the member.

8. The motor-vehicle central-lock system defined in claim 7 wherein the transmission includes a rotary gear carrying an eccentric pin coupled with the member.

9. The motor-vehicle central-lock system defined in claim 1 wherein the motor is fluid powered.

10. In a motor vehicle having a trunk door and a gas-filler door, a central lock system comprising:

respective latches at the trunk and gas-filler doors movable between locked and unlocked positions corresponding to locked and unlocked conditions of the respective doors;

an actuator fixed on the trunk latch and having a single output member displaceable in a straight line between an actuated and an unactuated position and having a pair of ends, and a motor connected to the member for displacing same between the respective positions;

means including respective trunk and gas-filler links connected to the respective latches and both connected to respective ends of the member for simultaneously displacing both the trunk and gas-filler latches into the respective unlocked conditions on displacement of the output member into the actuated position and into the respective locked conditions on displacement of the output member into the unactuated position; and control means connected to the motor for actuating same and thereby simultaneously moving the trunk and gas-filler latches between the locked and unlocked positions.

* * * * *